United States Patent [19]

Virta et al.

[11] Patent Number: 4,563,169

[45] Date of Patent: Jan. 7, 1986

[54] METHOD AND APPARATUS FOR FOLDING CONTAINER BLANKS

[76] Inventors: Arthur W. Virta, 209 Withorn La., Mt. Prospect, Ill. 60056; John R. Lane, 16W615 Honeysuckle 24F, Hinsdale, Ill. 60521

[21] Appl. No.: 383,581

[22] Filed: Jun. 1, 1982

[51] Int. Cl.[4] ..... B31B 7/00

[52] U.S. Cl. ..... 493/96; 493/126; 493/151; 493/179; 493/295

[58] Field of Search ..... 493/125, 126, 151, 295, 493/179, 178, 182, 181, 180, 96

[56] References Cited

U.S. PATENT DOCUMENTS

| | | | |
|---|---|---|---|
| 2,057,264 | 11/1935 | Pierce . | |
| 2,432,053 | 12/1941 | Waters . | |
| 2,502,117 | 3/1948 | Anderson . | |
| 3,072,095 | 4/1957 | Keessen et al. . | |
| 3,353,459 | 10/1964 | Owsley . | |
| 3,388,640 | 6/1966 | Giannella . | |
| 3,459,105 | 6/1967 | Waldbauer . | |
| 3,611,884 | 1/1970 | Hottendorf . | |
| 3,772,121 | 6/1971 | Peltier et al. . | |
| 3,964,953 | 6/1976 | Mitchard . | |
| 4,034,658 | 7/1977 | Sherman | 493/177 |
| 4,287,704 | 9/1981 | Meyers et al. | 493/179 X |
| 4,368,052 | 1/1983 | Bitsky et al. | 493/295 X |

*Primary Examiner*—James F. Coan

*Attorney, Agent, or Firm*—Dressler, Goldsmith, Shore, Sutker & Milnamow, Ltd.

[57] ABSTRACT

A method and apparatus for folding a flat container blank about parallel score lines to bring a glue flap on the blank into juxtaposed relationship with respect to a side panel of the blank. Gripping mechanisms are associated with an intermittently operated conveyor means for pulling a blank past a glue applying station, into the folding station, and into a compressing station where the manufacturers' joint is set. Release means is provided for opening the gripping mechanisms downstream of the compressing station, and a following set of gripper mechanisms push the freed blank from the machine. Further conveyor means may be associated with the apparatus for feeding a liner to the blank to produce a laminated folded and glued blank.

55 Claims, 11 Drawing Figures

METHOD AND APPARATUS FOR FOLDING CONTAINER BLANKS

TECHNICAL FIELD OF THE INVENTION

The present invention relates to a method and apparatus for folding and gluing container blanks. More specifically, the present invention relates to a compact, high-speed mechanized system, whereby flat blanks of scored corrugated material, which may or may not be laminated to like materials at least in certain portions thereof, are folded about score lines to bring portions of the blank into facing juxtaposed relationship with one another, with the juxtaposed portions being adhered together by glue or the like.

BACKGROUND OF THE INVENTION

Large corrugated containers are in widespread use today. Such containers or boxes are used to house for shipment bulky manufactured items, such as refrigerators, engines, transmissions and the like. Such containers are also in widespread use to house and ship particulate materials such as resin pellets, and such containers are commonly known in the art as "bulk bin boxes."

It is also well-known in the art to provide large corrugated containers of the type described in the preceding paragraph with a multi-ply, or multi-wall, laminated construction, at least in those portions of the container that are subjected to high stresses.

Such containers are typically formed from a prescored corrugated blank by folding the blank about the score lines to bring edge portions of sections of the blank into overlapping juxtaposed relationship, and forming a joint in the overlapped portions. Such a joint is referred to in the art as a "manufacturers joint," and is most commonly formed by applying a suitable adhesive to one or both of the overlapping blank sections.

While it has been known to form such containers by hand around the article, or articles, to be packaged; machines have been developed for automatically or semi-automatically folding a prescored corrugated blank and forming a glued manufacturer's joint therein.

So-called "folder-gluer" machines that have been developed to date have not met with widespread successful commercial use, because of a number of inherent problems associated therewith. Not the least of which problems is that such machines have tended to be extremely bulky, very costly, inconsistent and ineffective in use, and difficult and time consuming to convert from one size container to another.

Other prior art folder-gluer machines that have been used in the past are extremely labor intensive, and hence costly to operate, particularly when one considers the capital investment required for such equipment.

In one known type of folder-gluer apparatus, prescored blanks are fed past folding mechanisms, which fold the outboard blank panels about parallel score lines as the blank is conveyed past the folding mechanisms. Since the folding action with this type of equipment is accomplished progressively from one end of the blank to the other, as the blank is conveyed past the folding mechanism, difficulty is often encountered in accomplishing a square fold at the score lines, particularly when the leading edge of the blank is engaged by the folding mechanism. Non-square fold lines lead to subsequent stacking problems once the folding and gluing operation is completed.

Folding problems are also encountered with presently available high-speed equipment on heavy walled blanks, particularly multi-wall laminated blanks. Damage to the blanks and jamming of the equipment have resulted.

The method and apparatus of the present invention overcome the problems set forth above by providing a compact, relatively low cost, highly efficient folding and gluing system, which can be readily adjusted to accommodate blanks of differing size. Square folds can be consistently accomplished at high speeds with single wall and laminated blanks, with minimal labor involvement.

SUMMARY OF THE INVENTION

The problems which inhere in the prior art are overcome by the present invention, which includes an intermittently operated conveyor, that may be manually or automatically fed, and which transports blanks gripped by the conveyor serially past gluing, folding, compressing and discharge stations.

The gripper assemblies associated with the conveyor means positively grasp the leading edge of a blank fed to the conveyor, and pull the blank past the aforementioned stations along a horizontal work path. The gripper assemblies automatically, and positively, engage the leading edge of a blank fed thereto, by means of a blank grasping jaw mechanism which positively, yet releasably, engages the blank. In accordance with one of the novel aspects of the present invention, the gripping mechanisms release the blank after it has been glued, folded and compressed to set the manufactuter's joint while it is still on the conveyor means and disposed in the horizontal work path. The trailing end of the released blank is engaged by abutment surfaces on the next set of gripper mechanisms associated with the conveyor means, whereupon the released blank is pushed out of the machine as the next set of gripper mechanisms pulls the following blank into the compressing station. With this arrangement, a simplified and compact conveyor system results.

In accordance with another novel aspect of the present invention, glue is applied to an outwardly extending flap on the blank as it is moved by the gripper mechanisms from the blank loading end of the apparatus into the folding station. While the blank is held stationarily by the gripper mechanisms in the folding station, pivotally mounted folding arms are moved from a position below the horizontal work path into engagement with outer panels of the blank to fold such outer panels about parallel score lines to bring the glue flap into juxtaposed relationship with respect to an edge of the opposite blank panel. The folding arms simultaneously apply substantially equal force to opposite sides of the gripped blank, and the forces are applied to spaced locations at each side of the blank to insure a clean and square folding action. It has been found that laminated blanks of double and even triple wall thicknesses can be satisfactorily folded in this manner.

In accordance with another aspect of the present invention, control means are provided for the folding arms, preferably hydraulically operated control means, which cause differential movement between the folding arms at opposite sides of the blank at approximately the midpoint of the folding arm movement to insure that the glue flap will be disposed in juxtaposed overlapping, or underlapping, relationship with respect to the free edge of the opposite side of the blank.

In accordance with still another aspect of the present invention, the folding arm assemblies are adjustable inwardly and outwardly, not only to accommodate blanks of varying size, but also to insure that the folding arms can be accurately positioned relative to the score lines in the blank whereby said substantially perfectly square folds can be accomplished as the folding arms "break" the blank at the score lines. The adjustability of the folding arms also enables the manufacturers' joint to be located in an off-center position relative to the work path, if desired; and to accurately locate the manufacturers' joint with respect to subsequently actuated compression means for holding the glue flap in surface-to-surface contact with the opposite side of the blank as the glue thereon sets.

As is noted above, compression is applied to the manufacturers' joint subsequent to operation of the folding arms to bring the adhesive on the glue flap into intimate engagement with the adjacent surface of the opposite side of the blank. The compression means may take the form of a pivotally mounted hold-down arm, which is operable at the folding station after actuation of the folding arms and/or a vertically movable platen downstream of the folding station at a compression station. In any event, it is preferred to apply a combination of hot melt and cold melt glue to the glue flap, so that the hot melt adhesive will effectively set the manufacturers' joint sufficiently when the compression means is actuated while the blank is still on the conveyor means, and wherein the cold set adhesive subsequently sets to form a permanent and secure manufacturers' joint.

Other features, aspects and advantages of the invention will hereinafter become apparent from the following detailed description and the appended drawings.

DESCRIPTION OF PREFERRED EMBODIMENTS

Figure 1:
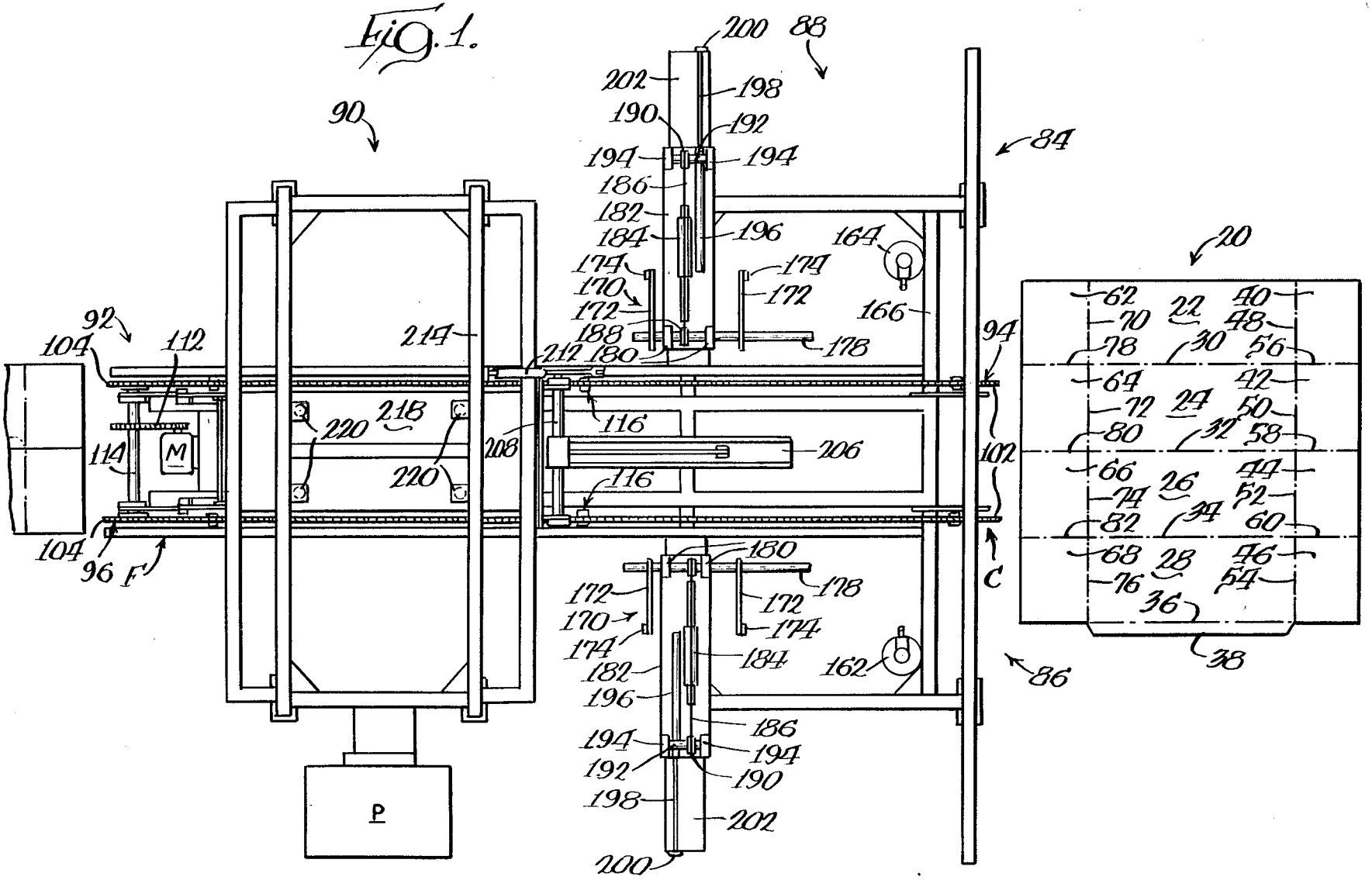
FIG. 1 is a top plan view of a folder gluer apparatus in accordance with the present invention.

While this invention is susceptible to embodiment in many different forms, there is shown in the drawings and will herein be described in detail preferred embodiments of the invention, with the understanding that the present disclosure is to be considered as an exemplification of the principles of the invention and is not intended to limit the invention to the embodiments illustrated. The scope of the invention is set forth in the claims appended hereto.

Referring now to the drawings, a typical blank 20 which is folded and glued in accordance with the principles of the present invention is illustrated in FIG. 1. Blank 20 consists of four rectangular panels or sections 22, 24, 26 and 28 connected to one another by parallel score or fold lines 30, 32, and 34. A glue flap 38 extends outwardly from the edge 36 of panel 28. Blank 20 further includes end panels 40, 42, 44 and 46 connected to panels 22, 24, 26 and 28 by respective score lines 48, 50, 52 and 54. End panels 40, 42, 44 and 46 are separated by slits 56, 58 and 60. Blank 20 further includes end panels 62, 64, 66 and 68 connected to panels 22, 24, 26 and 28 by respective score lines 70, 72, 74 and 76, with such end panels being separated from one another by slits 78, 80 and 82.

The apparatus of the present invention is indicated in its entirety by reference numeral 84, and includes a suitable frame F upon which a conveyor means C is mounted. Apparatus 84 defines a blank loading station 86, a blank folding station 88 downstream of blank loading station 86, a compressing station 90 downstream of folding station 88, and a discharge station 92 downstream of compressing station 90.

Figure 2:
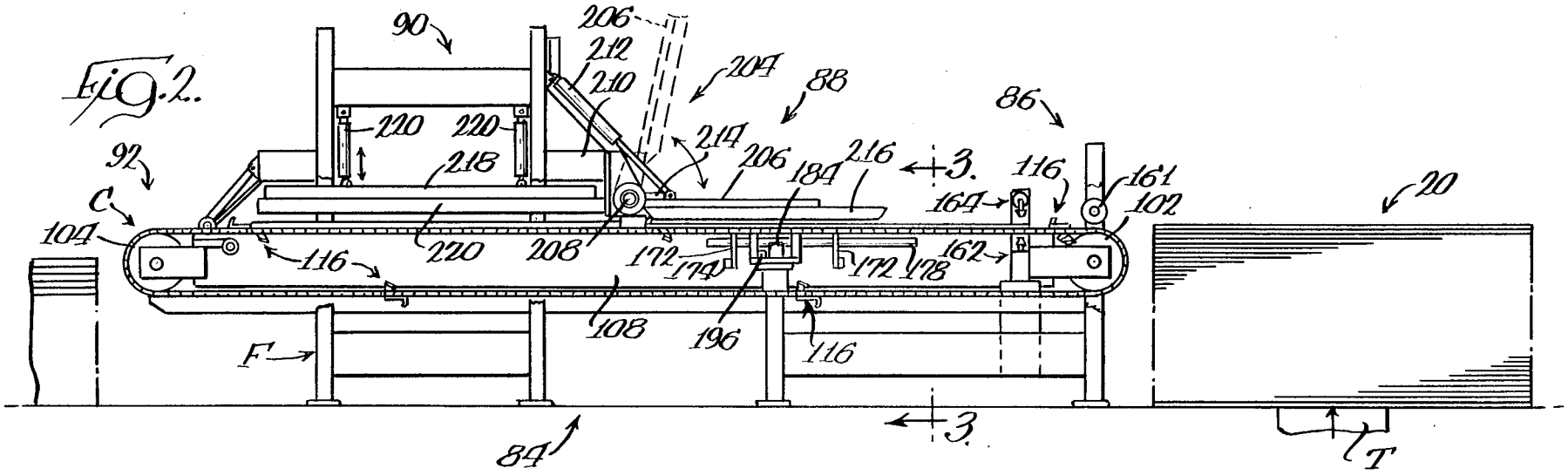
FIG. 2 is a side elevational view of the apparatus shown in FIG. 1.

As can be best seen in FIG. 2, a stack of blanks 20 is provided adjacent to blank loading station 86, and blanks 20 are preferably mounted on a vertically movable table T, so that the uppermost of the blanks in the stack is disposed in a horizontal plane with the upper reach of conveyor means C. The uppermost blank 20 in the stack of blanks is fed into the apparatus 84, either manually or automatically, by moving it from right to left, as viewed in FIG. 2, and blanks are then pulled progressively through the machine 84 along a horizontal work path from right to left where the blanks are glued, folded, sealed and discharged from the apparatus at discharge station 92 into a further stack at the left hand side of the apparatus, as shown in FIGS. 1 and 2. A turnaround press, not shown, may be provided at the discharge end of apparatus 84 for accepting folded and glued blanks from the apparatus, and for rotating alternate blanks 180° relative to one another for uniform stacking.

Conveyor means 20 includes two identical endless chain conveyors 94 and 96 (FIGS. 1, 3 and 4) that are positioned in spaced parallel relation with respect to one another. Each conveyor consists of a series of individually chain links 98 pivotally connected to one another in end-to-end relationship by pins 100 (FIG. 8) and which are trained around sprockets 102 and 104 at the loading and discharge ends of the apparatus, respectively. Links 98 travel along the horizontally disposed upper surface of a conveyor support member 106 (FIG. 8) that is secured to a vertical plate 108 supported upon frame F. Conveyors 94 and 96 may be driven by a motor M (FIG. 1) carried by the frame F, and connected to sprockets 104 by gears 112 and shaft 114. Motor M may be intermittently driven by means of a suitable electric circuit, forming no part of the present invention, housed within control panel P (FIG. 1) or elsewhere. A plurality of spaced gripper assemblies 116 are associated with each of conveyors 94 and 96, and the structure and operation of the gripper assemblies will be best understood from a consideration of FIG. 7 and 8.

Each gripper mechanism 116 includes an upper jaw member 118 and a lower jaw member 120. As is evident from FIG. 8, a pair of such jaw members is provided of each gripper mechanism of each of conveyors 94 and 96. Each jaw 120 is fixedly secured to the upper end of a pivotally mounted arm 122 by a bolt or set screw 124. As can be best seen in FIG. 7, gripper 120 includes an arcuate toothed gripping surface, which cooperates with an upwardly inclined end portion 126 of upper gripper jaw 118 to define an enlarged entrance opening for guiding the leading edge of a blank 20 into the gripper mechanism 116.

Each upper jaw 118 is secured to a downwardly inclined bracket 128 by screws 130. A generally L-shaped abutment member 132 is positioned forwardly of upper jaw member 118 (FIG. 7), and abutment member 132 includes a first leg 134 disposed below upper jaw 118 and a second leg 136 having an inclined upper end 136*a*. A spacer 138 is disposed below leg 134, and the aforementioned screws 130 securely unite the upper jaw member 118, L-shaped abutment member 132, spacer 138 and bracket 128. The leading edges of abutment member leg 136 and spacer 138 present present a pusher surface, which engages the trailing edge of a folded and glued blank for discharging the same from the apparatus 84, as will hereinafter be explained in more detail. The opposite sides 134*a* and 138*a* of the abutment member leg 134 and spacer 138 cooperate to define a stop surface engagable with the leading edge of the blank which is inserted into the apparatus 84 at the blank loading station 86.

One or more shims 140 may be interposed between the upper surface of abutment member leg 134 and the lower surface of upper jaw member 118 to accommodate blanks of differing thicknesses.

Figure 7:
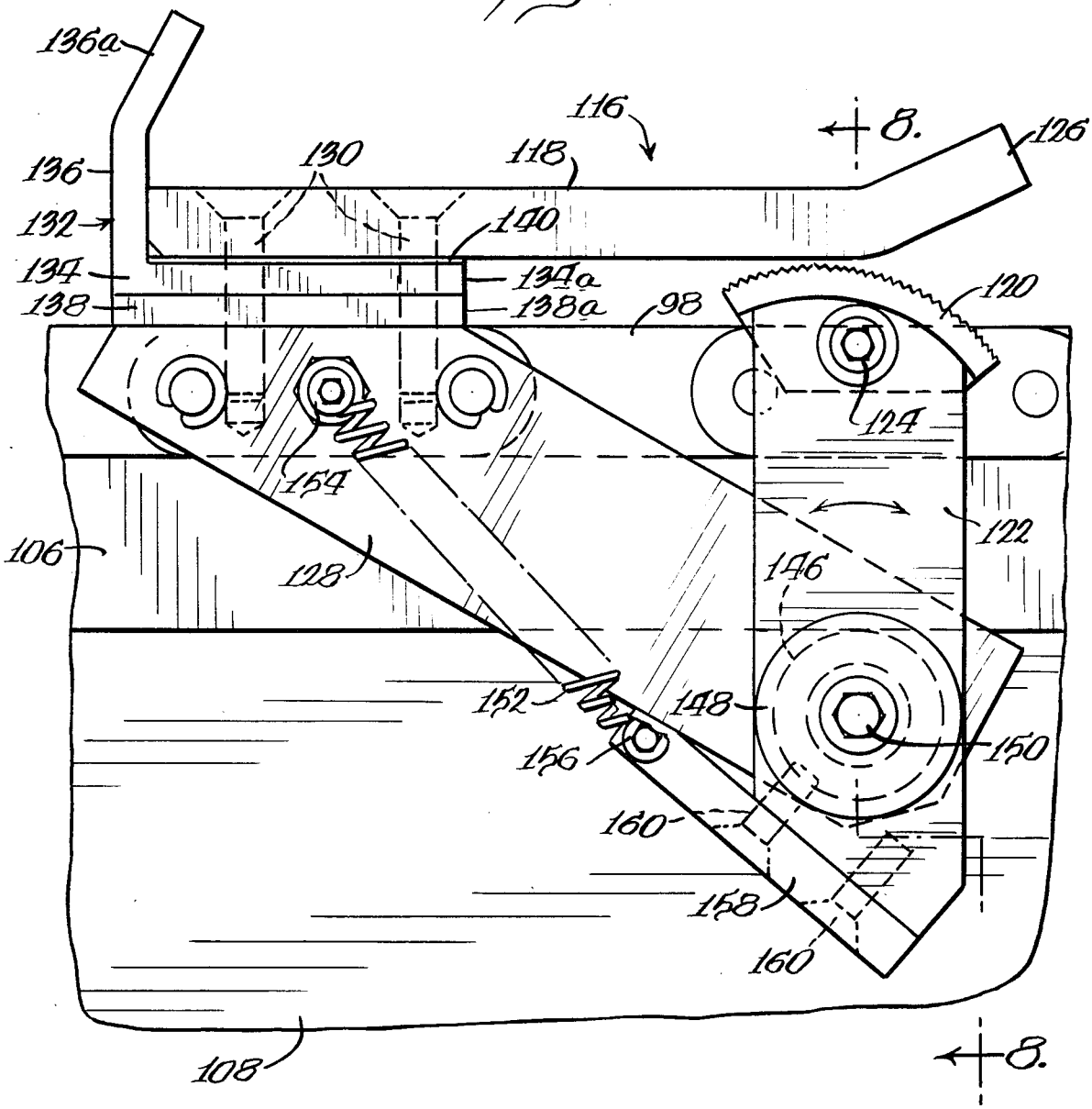
FIG. 7 is an enlarged side elevational view of the gripping mechanism.
Figure 8:
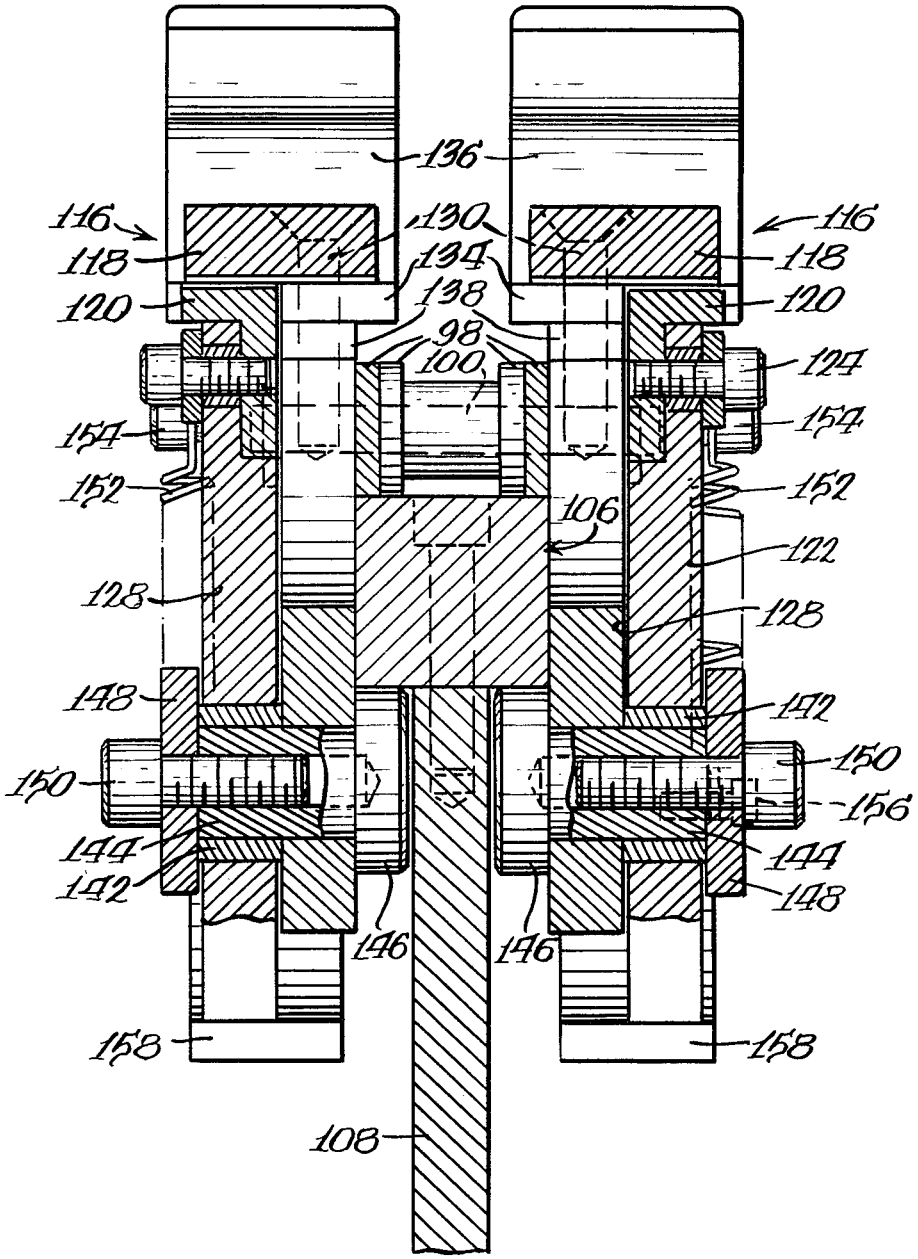
FIG. 8 is a cross-sectional view taken generally along line 8—8 of FIG. 7.

Arm 122 is pivotally mounted on the lower end of bracket 128 by a sleeve or bushing 142 which is disposed over an internally threaded stub shaft 144 having an enlarged head 146. A ring or washer 148 is held against the end of stub shaft 144 by a set screw 150 that threadably engages the internal passage of stub shaft 144. A spring 152 is connected between an upper spring mount 154 on bracket 128 and a lower spring mount 156 on a cam follower member 158 secured to the lower end of arm 122 by screws 160 (FIG. 7). As is clear from FIG. 7, spring 152 biases arm 122 in a clockwise direction to urge the teeth on gripping member 120 toward the lower surface of upper gripping member 118. When a blank is inserted between gripping members 118 and 120 and butted against the stop surfaces 134*a* and 138*a*, arm 122 will pivot counterclockwise against the bias of spring 152, and when conveyor means C moves to the left, spring 152 functions to urge lower gripping member 120 into firm gripping engagement with the blank which is securely held between gripping members 118 and 120.

As is noted above, conveyor means C is intermittently driven. With reference to FIGS. 1 and 2, it will be noted that a set of gripper members 116 are located at the blank loading station 86 during a dwell period of the conveyor means. When a blank 20 is shifted from right to left into the awaiting gripper mechanisms 116 it passes beneath a guide roller 161, and the leading edge of the blank engages the stop surfaces of the gripper mechanisms 116, so that the blank is positively and accurately positioned with respect to the folding arm mechanisms to be hereafter described. Once the leading edge of the blank has been aligned and securely gripped, the conveyor means C is indexed to pull the gripped blank 20 from the loading station 86 into the folding station 88 at which time the conveyor means C stops, and a new set of gripper mechanisms 116 are located at the blank loading station 86 for receipt of a further blank 20.

A suitable adhesive is applied to glue flap 38 as the gripped and aligned blank 20 is moved from the loading station 86 to the folding station 88. In this regard, a source of adhesive 162 may be mounted upon subframe 166 (FIG. 1) and sprayed, wiped, or otherwise suitably applied to flap 38. Alternatively, a source of suitable adhesive may be provided as shown at 164 in FIG. 1, and applied to the edge of blank section 22.

While the specific adhesive material that is applied to flap 38 is not critical to the present invention, the present invention contemplates that either cold set or hot melt adhesives may be used, or a combination of such adhesives. When a hot melt adhesive is applied in combination with a cold set adhesive, the hot melt adhesive will permit a quick tack to bond the flap 38 to the opposite edge of panel 22. While the hot melt provides temporary adhesion, the cold set adhesive in the manufacturers' joint will cure both during passage of the blank through the machine and after the folded and glued blank has been discharged from the machine. The combination of hot melt and cold set adhesives permits the utilization of a very small amount of relatively expensive hot melt adhesive, and yet preserves the integrity and strength of the bond provided by the less expensive cold set adhesive.

Figure 3:
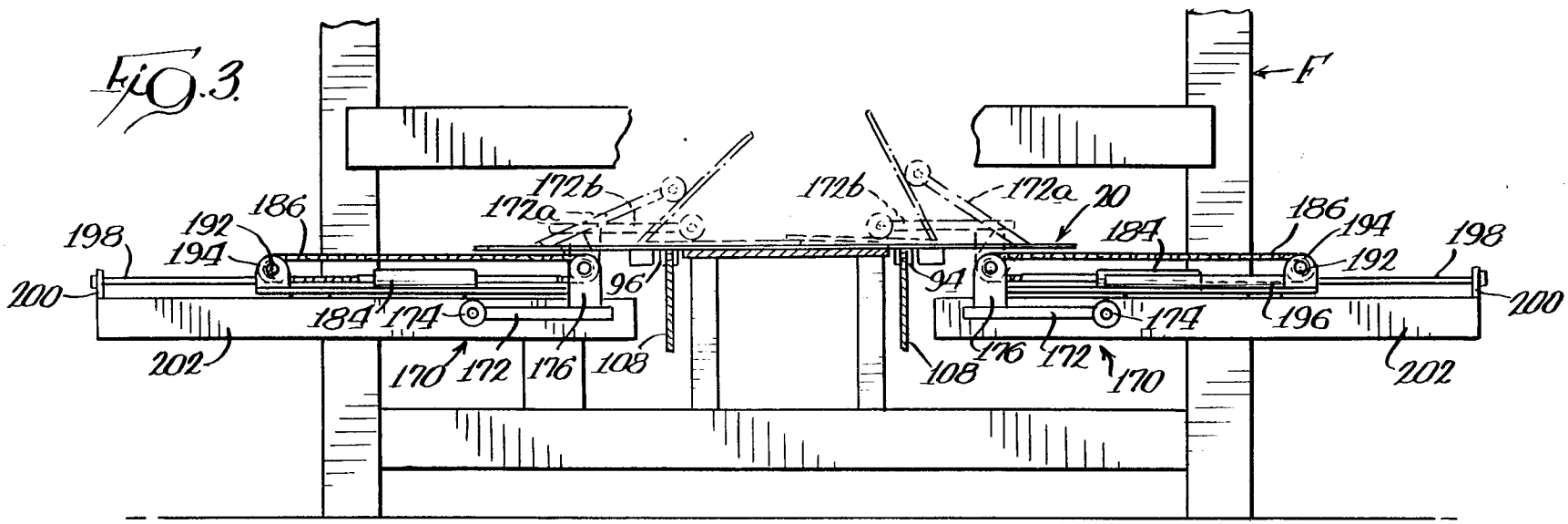
FIG. 3 is a cross-sectional view taken generally a long line 3—3 of FIG. 2.

After the glued blank has been transported into the folding station 88 and the conveyor means C stopped, generally identical folding arm mechanisms 170 at opposite sides of the conveyor means C are actuated, as will be best understood from a consideration of FIGS. 1 and 3. Each folding arm mechanism 170 includes a pair of spaced folding arms 172 having a blank engaging roller 174 at the free end thereof. The opposite ends of arms 172 are secured to links 176, which are in turn secured to shafts 178. Shafts 178 are mounted for pivotal movement in upstanding brackets 180 secured to frame members 182. As is evident from FIG. 3, when conveyor means C moves a gripped blank into the folding station 88, arms 172 are located in the full line position of FIG. 3 and disposed below the horizontal travel path of the blank 20.

Means is provided for simultaneously pivoting both the folding arm assemblies 170 after the blank 20 has come to rest in the folding station 88. Such means includes a double acting fluid ram 184 which is connected to an endless chain conveyor 186. Conveyors 186 are trained over a first sprocket 188 fixed to a shaft 178, and a second sprocket 190 fixed to shaft 192, that is mounted for movement between upstanding supports 194 on frame member 182. Operation of the fluid rams 184 in one direction causes the conveyors 186 to pivot the arms 172 from the full line position shown in FIG. 3 through an intermediate position shown in dotted lines at 172*a*, and to a fully folded position shown in dotted lines at 172*b*. Actuation of the fluid rams 184 in an opposite direction reverses movement of the folding arms 172 back to the full line position shown in FIG. 3 below the feed path of the blanks 20.

As is evident from FIG. 1, the folding arm mechanisms 170 are located directly opposite of one another and on opposite sides of the conveyor means C. In this regard, the spaced folding arms 172 on one side of the conveyor means C are aligned with the folding arms 172 on the opposite side of the conveyor means C. Thus, when fluid rams 184 are actuated to pivot the folding arms 172 upwardly rollers 174 on both sets of folding arms 172 will simultaneously engage blank panels 22 and 28, so that substantially equal and oppositely directed folding forces are applied to the blank 20. Of course, the blank 20 remains positively gripped by the gripper mechanisms 116 at the folding station 88 as the folding arms 172 pivot upwardly, and thus a clean and sharp break is accomplished as the folding arms 172 continue to pivot upwardly to fold blank panels 22 and 28 about score lines 30 and 34, respectively.

The control means for fluid rams 184 is constructed and arranged so that at approximately the mid-point of the folding arm movement (approximately at a 90 degree position), the folding arm mechanism 170 at one side of the conveyor means is caused to move more slowly than the folding arm mechanism at the opposite side of the conveyor means. With reference to FIG. 3, it will be seen from the position shown in broken lines at 172*a* that the left-hand folding arm has pivoted through a greater angular extent than the right-hand folding arm. This insures that the glue flap will be brought into juxtaposed surface-to-surface relationship with the edge of the panel at the opposite side of the blank without interference. The control means is preferably adjustable, so that the operator can select which set of folding arms will precede the other.

Folding arm mechanisms 170 are movable inwardly and outwardly relative to the conveyor means C so as to provide a means for accurately locating the pivot axis of shafts 178 in the desired location immediately outwardly of the score lines and immediately therebelow. The adjustment means also enables the apparatus to accommodate blanks of varying size. Such adjustment means includes fluid ram means 196 having its cylinder end mounted upon frame member 182, and having its rod end 198 connected to an upwardly extending member 200 secured to fixed frame member 202. The control means for the apparatus of the present invention is preferably constructed and arranged so that the fluid ram means 196 can be independently adjusted, and fluid ram means 196 are preferably hydraulic cylinders which can be hydraulically moved and hydraulically locked in any desired position of adjustment.

A hold-down mechanism 204 is provided at the folding station 88 to insure that the manufacturers' joint is set once the folded blank resumes its movement through the machine.

The hold-down mechanism includes an arm 206 mounted for pivotal movement with shaft 208, as can be best seen in FIGS. 1 and 2. Shaft 208 is supported above the path of blank movement, perpendicular thereto, by bracket means 210. The cylinder end of a fluid ram 212 is connected to a frame member 214, and the rod end of fluid ram 212 is connected to a link 214 fixed to shaft 208. Fluid ram means 212 is operable to move the hold-down arm 206 from the broken line position of FIG. 2, which it occupies as the blank is fed into the folding station 88 and while the folding arms 172 fold the outer blank panels into superposed relationship with one another, to the full line position of FIG. 2 once the folding arms 172 have commenced their return movement toward the full line position of FIG. 3 so as to clear the area of the manufacturers' joint. The lower side 216 of the hold-down arm 206 is faced with a soft sponge-type rubber, or other suitable resilient material, for engaging the folded blank in the area of the glue tab 38 after the folded side panels have been released by the folding arms 172. Hold-down arm 206 remains in the full line position of FIG. 2 in engagement with the manufacturers' joint until the conveyor means C indexes and moves the leading edge of the folded blank under platen 218 to be subsequently described.

Hold-down arm 206 can perform independent functions, depending upon the nature of the adhesive that is applied to flap 38. For example, when a hot melt adhesive is used, fluid ram means 212 will cause the hold down arm 206 to deliver a sharp blow to the manufacturers' joint, which will bring the flap 38 into intimate contact with the side wall of the blank to effectively "tack" the manufacturers' joint. Alternatively, the control system for fluid ram 212 may be constructed and arranged so that hold-down arm 206 applies a heavy mechanical pressure to the manufacturers' joint to retain the adhesive on flap 38 in intimate adherent relationship with respect to the superposed portion of the blank. When a combination of cold set and hot melt adhesives are applied to flap 38 the pressure applied by hold-down arm 206 enables the hot melt adhesive to bond the flap 38 to the superposed portion of the blank and the cold set adhesive will begin to set up while the folded blank is still on the machine 84.

As noted above, after the folding arms 172 have been returned to their retracted position below the work path, conveyor means C begins to index with the hold-down arm 206 in the full line position of FIG. 2. After the leading edge of the folded blank passes beneath platen 218, hold-down arm 206 is pivoted to the broken line position of FIG. 2, and conveyor means C pulls the folded blank into position beneath the platen 218, at which time movement of the conveyor means is stopped.

Fluid motor means 220 are connected between the frame F and the platen 218 and move the platen 218 downwardly once movement of the conveyor means C has stopped. Platen 218 includes a resilient underlayer 220 for applying compressive force to the folded blank at the compressing station 90. The platen 218 applies pressure to the folded blank for a sufficient amount of time to enable the manufacturers' joint to remain set once the folded blank is discharged from the machine. Control means may be provided to adjust the length of the time of compression. After the platen has remained in engagement with the folded blank for the desired length of time, and then moved vertically upwardly out of engagement with the folded and glued blank, conveyor means C indexes once again, and gripper means 116 begin to pull the folded and glued blank outwardly from the compressing station 90 and toward the discharge end 92 of the machine.

Figure 4:
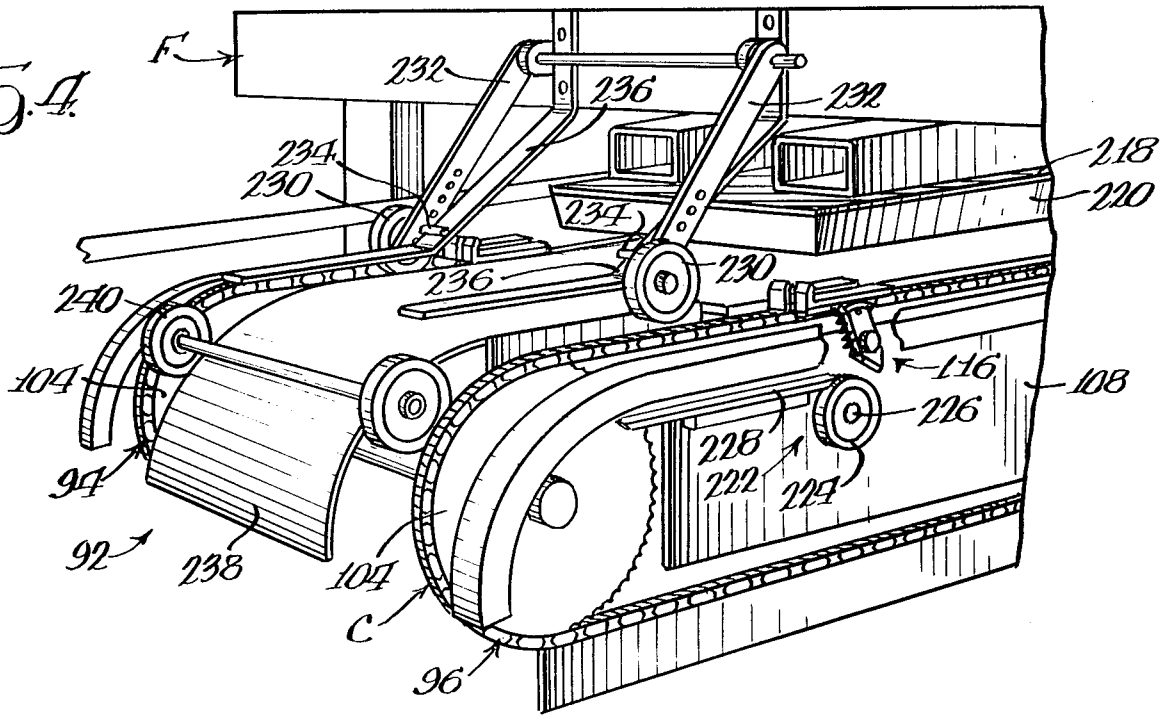
FIG. 4 is a perspective view at the discharge end of the apparatus.
Figure 5:
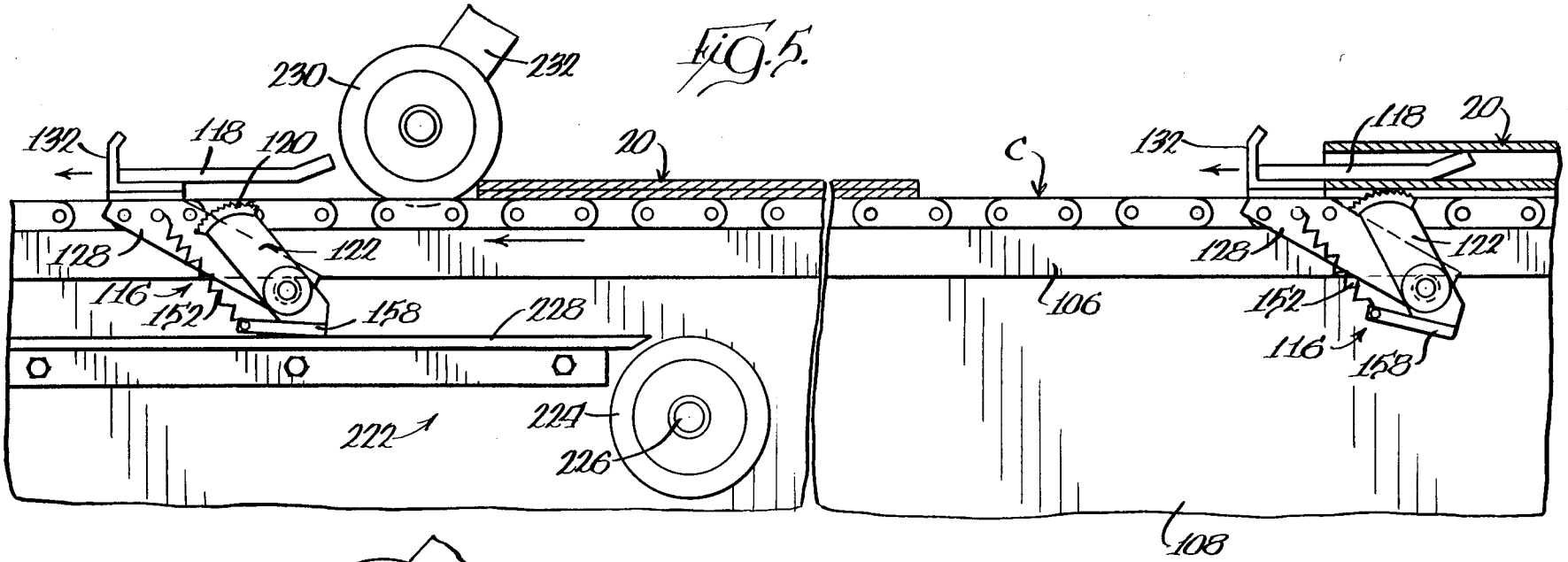
FIG. 5 is an enlarged fragmentary side elevational view illustrating the blank gripper and conveyor means.
Figure 6:
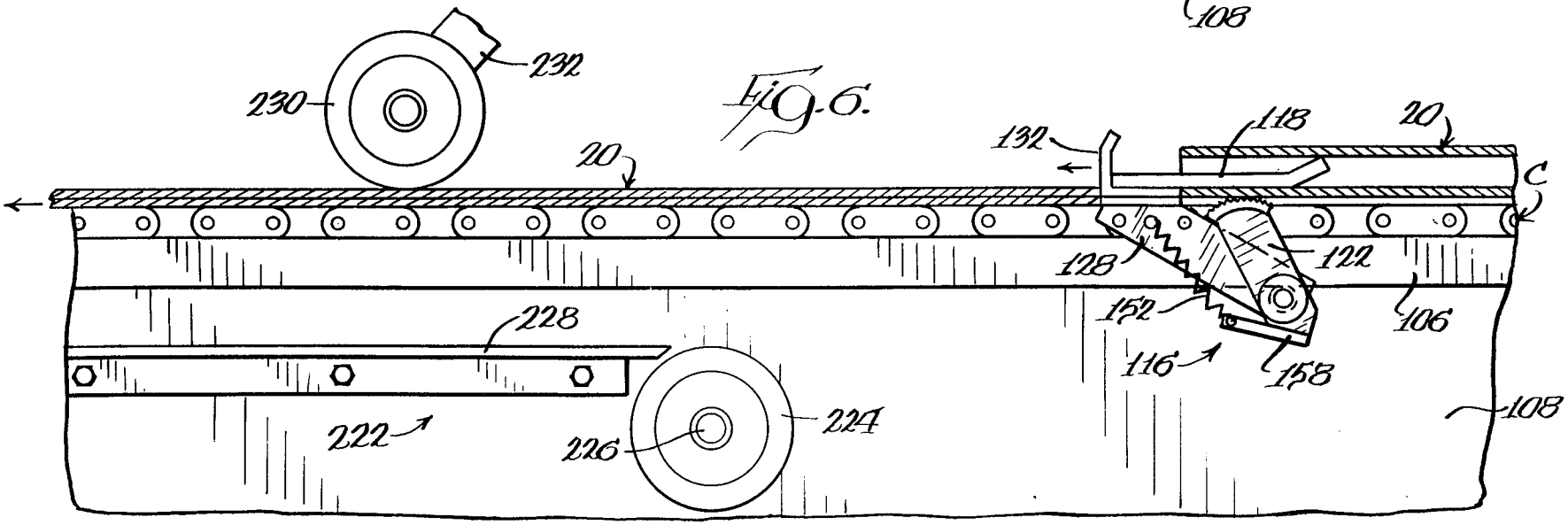
FIG. 6 is a view similar to FIG. 5 and illustrating the pushing discharge action.

Release means 222 is provided for opening the jaws of the gripping mechanisms 116 shortly after the compressed folded blank moves out of the compressing station 90, and the release means 222 will be best understood from a consideration of FIGS. 4, 5 and 6. The release means 222 includes a roller cam 224 carried by shaft 226 with the circumferential surface of cam 224 being disposed in the path of movement of cam follower 158. Release means 222 further includes a cam track member 228 secured to plate 108, with the upper surface of track member 228 being disposed tangentially with respect to the circumferential surface of roller cam 224. Blank restraining rollers 230 are carried by arms 232, which are supported from frame F, and rollers 230 are engagable with the leading edge of a folded and glued blank 20, as is shown in FIG. 5, to hold the blank 20 in a fixed position on the machine after the gripping mechanisms 116 have been released by release means 222.

With reference to FIG. 5, when cam follower 158 engages the cam surface of cam 224, arm 122 is pivoted in a counterclockwise direction against the bias of spring 152, and cam gripping member 120 is moved out of blank gripping engagement with the leading edge of the blank. At the time cam follower 158 moves into engagement with the cam surface of cam 224 and gripper 120 is moved out of engagement with the blank, the leading edge of the folded and glued blank 20 engages restraining rollers 230, which hold the freed blank 20 in the position shown in FIG. 5. Gripping members 120 remain out of engagement with the blank as the cam followers 158 traverse along the track 228. Once the cam followers 158 move off the track 228 and gripper mechanisms 116 begin their movement around sprockets 104, springs 152 pivot arms 122 in a clockwise direction to locate gripping member 120 adjacent to gripping member 118 for accepting another blank as the gripping mechanisms 116 travel along the lower reach of the conveyor means C back toward the blank loading end of the machine.

As will be evident by comparing FIGS. 5 and 6, when a trailing set of gripping members 116 move toward the compressing station 90, the abutment surfaces at the forward end thereof will engage the trailing end of the blank 20 that is held in position by restraining rollers 230. As the following gripping mechanisms 116 continue to move toward the compressing station 90, they apply a pushing force to the blank 20 so that the leading edge of the blank pushes the rollers 230 and arms 232 upwardly to permit the blank 20 to be pushed toward the discharge end 92 of the machine. As can be seen in FIG. 4, arms 232 include stop pins 234 which rest upon inclined support members 236 once the arms 232 pivot downwardly after rollers 230 clear the trailing end of the blank pushed off the discharge end 92 of the apparatus. Arms 234 are secured to frame F by suitable fastening means.

The discharged blank is guided from the machine by arcuate discharge member 238 and guide rollers 240 positioned thereabove. A turnaround press, not shown, may be provided at the discharge end 92, for rotating alternate discharged folded and glued blanks 180 degrees with respect to one another, so that the manufacturers' joints of such alternate blanks will be stacked opposite to one another to provide a uniform stack of discharged blanks.

Figures 9, 10, 11:
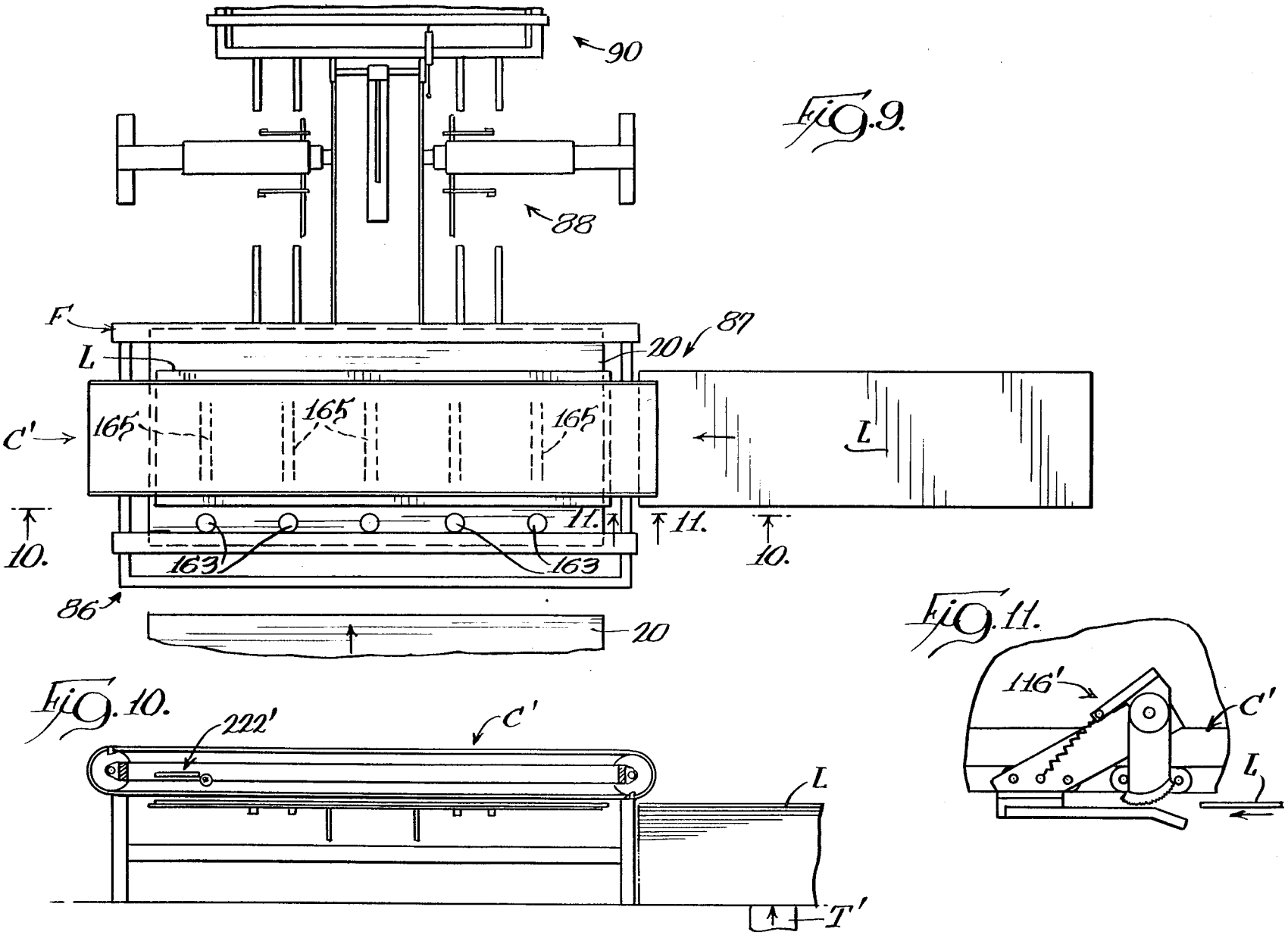
FIG. 9 is a fragmentary top plan view of a further embodiment the invention for forming a laminated folded and glued blank.
FIG. 10 is a fragmentary end view taken generally along line 10—10 of FIG. 9.
FIG. 11 is a fragmentary end view taken generally along line 11—11 of FIG. 9.

Referring now to FIGS. 9–11, the method and apparatus illustrated therein is the same as that previously described, except that a liner applying station 87 is interposed between the blank loading station 86 and blank folding station 88. The adhesive dispensing means for the laminator-folder-gluer of FIGS. 9–11 is modified to include a plurality of dispensers 163 which distribute the adhesive in desired patterns, such as those shown in broken lines at 165 in FIG. 9. As with the dispensing means that is utilized to apply the adhesive for the manufacturers' joint, the adhesive means for securing the liner to the blank preferably is a combination of hot melt and cold set adhesives.

With reference to FIGS. 9 and 10, a stack of liners L is provided at liner applying station 87, and may be supported upon a vertically movable table T'. Conveyor means C', generally identical to previously described conveyor means C, is positioned above the work path of blanks 20, and disposed perpendicularly with respect to such work path. A gripping mechanism 116', generally identical to previously described gripping mechanism 116, receives a liner L, as is evident from FIG. 11, and transports the gripped liner from right to left as shown in FIG. 10 to dispose the same in superposed relationship with respect to a blank 20. Liners L preferably have a score line pattern corresponding to the score line pattern of the blank 20, and release means 222', generally identical to previously described release means 222, is provided for releasing gripper members 116' to locate the score lines in liner L in alignment with the score lines in blank 20. The remainder of the method performed by the apparatus illustrated in FIGS. 9–11 is identical to that previously described above.

We claim:

1. Apparatus for folding and gluing container blanks comprising: frame means having a blank loading end and a blank discharge end; conveyor means mounted for movement relative to said frame means from the blank loading end thereof to the blank discharge end thereof; at least two gripper means on said conveyor means, each said gripper means having a gripper jaw mechanism adapted to receive and securely hold the leading edge of a container blank when the gripper means is located at the blank loading end of said frame means; dispensing means on said frame means downstream of said blank loading end for applying glue to a flap on said blank; folding means on said frame means downstream of said dispensing means for folding said blank about parallel score lines and to position said flap in juxtaposed relationship with respect to a side panel of the blank; compression means on said frame means downstream of said folding means for holding said flap against said side panel whereby said flap is adhered to said side panel; release means on said frame means downstream of said compression means for opening the gripper jaw mechanism and releasing said blank therefrom; and abutment means associated with the following gripper means engageable with a trailing edge of the released blank for discharging the folded and glued blank from the discharge end of the frame means.

2. Apparatus as set forth in claim 1 including drive means for moving said conveyor means intermittently relative to said frame means, said folding means being operable when said conveyor means is stopped.

3. Apparatus as set forth in claim 2 wherein said conveyor means is arranged to move the blank through a straight-line horizontal work path between said loading and discharge ends of said frame means.

4. Apparatus as set forth in claim 3 wherein said dispensing means is arranged to apply glue to said flap as said blank is conveyed from the loading end of said frame means into position adjacent said folding means.

5. Apparatus as set forth in claim 3 including a second conveyor means mounted for movement relative to said first mentioned conveyor means in a direction perpendicular to the path of movement of said first mentioned conveyor means, said second conveyor means being located upstream of said folding means; and releasable gripper means on said second conveyor means for transporting a liner into superposed relationship with respect to said blank.

6. Apparatus for folding and gluing container blanks comprising: frame means having a blank loading end and a blank discharge end; conveyor means mounted for intermittment movement relative to said frame means along a straight-line horizontal path from the blank loading end of the frame means to the blank discharge end thereof; at least two gripper means on said conveyor means, each said gripper means having a gripper jaw mechanism adapted to receive and securely hold the leading edge of a container blank when the gripper means is located at the blank loading end of said frame means; dispensing means on said frame means downstream of said blank loading end for applying glue to a flap on said blank as said blank is conveyed away from the loading end of said frame means; folding means on said frame means downstream of said dispensing means and operable when said blank is stopped for folding said blank about parallel score lines to position said flap in juxtaposed relationship with respect to a side panel of the blank; hold-down means on said frame means in alignment with said juxtaposed flap; means for moving said hold-down means between a clearance position and a position in engagement with said flap to bring the glue thereon into contact with the adjacent underlying area of the side panel of the blank; compression means on said frame means downstream of said hold-down means and operable when said blank is stopped for holding said flap against said side panel, whereby said flap is adhered to said side panel; release means on said frame means downstream of said compression means for opening the gripper jaw mechanism and releasing said blank therefrom; and abutment means associated with the following gripper means engageable with a trailing edge of the released blank for discharging the folded and glued blank from the discharge end of the frame means.

7. The method of serially converting a scored container blank into a folded and glued form comprising the steps of:

providing a supply of flat corrugated blanks, each blank having two outer side panels connected to inner side panels of the blank by parallel score lines, one of said outer panels having an outwardly extending flap thereon for adhering said one outer panel to the other outer panel of the blank; feeding blanks one at a time from said supply into a gripping mechanism having gripper jaw means configured to open by insertion of the leading edge of said blank therein for securely gripping the leading edge of said blank with said gripping mechanism; conveying said gripped blank along a work path including a glue applying station, a folding station and a pressure applying station; applying glue to said blank at said glue applying station; folding said outer panels inwardly about said score lines at said folding station to position said outwardly extending flap in juxtaposed relationship with respect to the other outer panel; applying pressure to said flap against said other outer panel at said pressure applying station until the glue on said blank bonds said flap to said other outer panel; therafter releasing said gripping mechanism to free the folded and glued blank for movement independent of said gripping mechanism; and discharging said folded and glued blank out of said work path to a discharge zone.

8. Apparatus for folding and gluing container blanks comprising: frame means having a blank loading end and a blank discharge end; first conveyor means mounted for movement relative to said frame means along a first straight-line work path from the loading end of the frame means to the blank dischage end thereof; at least two gripper means on said first conveyor means, each said gripper means having a gripper jaw mechanism adapted to receive and securely hold the leading edge of a container blank when the gripper means is located at the blank loading end of said frame means; dispensing means on said frame means downstream of said blank loading end for applying glue to a flap on said blank; second conveyor means mounted for movement relative to said frame means along a second straight-line work path perpendicular to said first straight-line work path adjacent to the blank loading end of said frame means; releasable gripper means on said second conveyor for transporting a liner into superposed relationship with respect to said blank; folding means on said frame means downstream of said dispensing means for folding said blank and superposed liner about parallel score lines to position said flap in juxtaposed relationship with respect to a side panel of the blank; compression means on said frame means downstream of said folding means for holding said flap against said side panel, whereby said flap is adhered to said side panel; release means on said frame means downstream of said compression means for opening the gripper jaw mechanism and releasing said blank therefrom; and abutment means associated with the following gripper means engageable with a trailing edge of the released blank for discharging the folded and glued blank from the discharge end of the frame means.

9. Apparatus as set forth in claim 8 wherein said dispensing means is arranged to apply glue to said blank for adhering said liner thereto.

10. Apparatus for folding and gluing container blanks comprising: frame means having a blank loading end and a blank discharge end; conveyor means mounted for movement relative to said frame means from the blank loading end thereof to the blank discharge end thereof; at least two gripper means on said conveyor means; each said gripper means having a gripper jaw mechanism adapted to receive and securely hold the leading edge of a container blank when the gripper means is located at the blank loading end of said frame means; dispensing means for applying glue to a flap on said blank; folding means on said frame means for folding said blank about parallel score lines and to position said flap in juxtaposed relationship with respect to a side panel of the blank; compression means on said frame means for holding said flap against said side panel, whereby said flap is adhered to said side panel; release means on said frame means downstream of said compression means for opening the gripper jaw mechanism and releasing said blank therefrom; and abutment means associated with the following gripper means engageable with a trailing edge of the released blank for discharging the folded and glued blank from the discharge end of the frame means.

11. Apparatus as set forth in claim 10 including a second conveyor means mounted for movement relative to said frame means in spaced parallel relationship with respect to said first mentioned conveyor means, said second conveyor means being generally identical with said first conveyor means; and wherein abutment means on each conveyor means is aligned with one another for engaging the leading edge of a container blank.

12. Apparatus as set forth in claim 11 including drive means for moving said first and second conveyor means intermittently relative to said frame means, said folding means being operable when said first and second conveyor means are stopped.

13. Apparatus as set forth in claim 12 wherein said folding means includes a first folding mechanism adjacent to said first conveyor means and a second folding mechanism adjacent to said first conveyor means opposite said first folding mechanism, and drive means operatively associated with said first and second folding mechanisms for simultaneously applying opposite and generally equal folding forces to said blank.

14. Apparatus as set forth in claim 13 wherein each folding mechanism includes at least one arm member mounted for pivotal movement relative to said frame means, and fluid motor means for pivoting said arm members to fold said blank about said parallel score lines.

15. Apparatus as set forth in claim 14 in which said frame means supports said blank horizontally adjacent to said folding mechanisms, and wherein the pivot axis for each of said arm members is disposed horizontally below and outwardly of one of the score lines of said blank.

16. Apparatus as set forth in claim 15 including means for moving said folding mechanisms inwardly and outwardly relative to said frame means so as to acommodate blanks of different size.

17. Apparatus as set forth in claim 10 in which said compression means is a hold-down member pivotally mounted on said frame means, said hold-down member being aligned with said flap when said flap is positioned in juxtaposed relationship with respect to a side panel of said blank; and wherein means is provided for moving said hold-down member into engagement with said blank.

18. Apparatus as set forth in claim 17 wherein resilient means is provided on the blank engaging surface of said hold-down member.

19. Apparatus as set forth in claim 17 in which said compression means further includes a platen mounted for vertical movement relative to said frame means downstream of said hold down member; and wherein drive means is provided for moving said platen into engagement with said blank.

20. Apparatus as set forth in claim 10 wherein said dispensing means is located on said frame means upstream of said folding means for applying glue to the flap during movement of the blank from the loading end of the frame means toward the folding means.

21. A gripper mechanism for use in a container blank folding and gluing machine comprising:

a bracket having means thereof for attaching the bracket to a conveyor; a first blank clamping member fixedly secured to said bracket; a second blank clamping member pivotally mounted on said bracket, said second blank gripping member having a toothed blank gripping surface thereon facing a blank gripping surface on said first blank clamping member; means biasing said second blank clamping member to urge the toothed blank gripping surface thereon toward the blank gripping surface on said first blank clamping member; whereby the leading edge of a blank may be inserted between said first and second blank clamping members whereby said blank engages and coacts with said second blank clamping member so as to pivot said second blank clamping member relative to said bracket, said blank being securely clamped between said blank gripping surfaces through the action of said biasing means; and abutment means on said second blank clamping member relative to said bracket against the bias of said biasing means and for moving said toothed blank gripping surface relative to the blank gripping surface on said first blank clamping member for releasing said blank gripping surfaces from clamping engagement with said blank.

22. A gripper mechanism as set forth in claim 21 wherein said toothed gripping surface is arcuately shaped.

23. A gripper mechanism as set forth in claim 22 wherein the free end of said first clamping member is inclined away from said toothed gripping surface to define an enlarged opening facilitating insertion of the leading edge of the blank.

24. A gripper mechanism as set in claim 23 including stop means inwardly of said enlarged opening for engaging the leading edge of the blank.

25. The method of claim 7 further characterized by securely gripping the leading edge of the blank at laterally spaced locations by a pair of gripper mechanisms.

26. A conveyor mechanism for use in a container blank folding and gluing machine comprising: a series of conveyor links connected to one another to form a closed conveyor loop; a bracket having means thereon for attaching the bracket to at least one of said conveyor links; a first blank clamping member fixedly secured to said bracket; a second blank clamping member pivotally mounted on said bracket, said second blank gripping member having a toothed blank gripping surface thereon facing a blank gripping surface on said first blank clamping member; means biasing said second blank clamping member to urge the toothed blank gripping surface thereon toward the blank gripping surface on said first blank clamping member; whereby the leading edge of a blank may be inserted between said first and second blank clamping member whereby said blank engages and coacts with said second blank clamping member so as to pivot said second blank clamping member relative to said bracket, said blank being securely clamped between said blank gripping surfaces through the action of said biasing means; and abutment means on said second blank clamping member for pivoting said second blank clamping member relative to said bracket against the bias of said biasing means and for moving said toothed blank gripping surface relative to the blank gripping surface on said first blank clamping member for releasing said blank gripping surfaces from clamping engagement with said blank.

27. A conveyor mechanism as set forth in claim 26 including abutment means inwardly of said blank gripping surfaces engageable with the leading edge of a blank.

28. The method of serially converting a scored container blank into a folded and glued form comprising the steps of: providing a supply of flat corrugated blanks, each blank having two outer side panels connected to inner side panels of the blank by parallel score lines, one of said outer panels having an outwardly extending flap thereon for receipt of glue for adhering said one outer panel to the other outer panel of the blank; feeding blanks one at a time from said supply into a gripping mechanism and securely gripping the leading edge of said blank with said gripping mechanism; conveying said gripped blank along a work path including a glue applying station, a folding station and a compressing station; applying glue to said outwardly extending flap at said glue applying station; folding said outer panels inwardly about said score lines at said folding station to position said outwardly extending flap in juxtaposed relationship with respect to the other outer panel; compressing said flap against said other outer panel at said compressing station until the glue on said flap bonds said flap to said other outer panel; thereafter releasing said gripping mechanism to free the folded and glued blank for movement independent of said gripping mechanism; engagging the trailing end of said blank with the leading edge of a following gripping mechanism; and moving said following gripping mechanism to push said folded and glued blank out of said work path to a discharge zone.

29. The method of claim 28 wherein said conveying step is performed by intermittently moving said blank along a horizontal straight-line work path, said folding and compressing steps being performed while said blank is stopped.

30. The method of claim 29 wherein said glue applying step is performed as said blank is moved into said folding station.

31. The method of claim 29 wherein said folding step is performed by simultaneously applying folding forces to said outer panels from opposite sides of said panel at said folding station.

32. The method of claim 31 in which said folding step is further characterized by simultaneously pivoting folding arms into engagement with said outer panels, and controlling the rate of movement of one of said folding arms whereby said outwardly extending flap is positioned in juxtaposed relationship with respect to the other outer panel.

33. The method of claim 32 including the further step of moving a hold-down member into engagement with said juxtaposed flap to bring the glue thereon into contact with the other outer panel.

34. The method of claim 33 further characterized by maintaining said hold-down member in engagement with said flap as movement of said blank from said folding station toward said compressing station is commenced.

35. The method of claim 29 wherein said compressing step is performed by moving a platen into engagement with the folded blank at least in the area of said juxtaposed flap, and retaining said platen in engagement with the blank until said glue begins to set.

36. The method of claim 35 wherein said gripping mechanism is released after the blank is moved partly out of said compressing station.

37. The method of claim 28 including the step of conveying a liner into superimposed relationship with respect to said blank upstream of said folding station, and adhering said liner to said blank prior to said folding step.

38. The method of serially converting a scored container blank into a folded and glued form comprising the steps of: providing a supply of flat corrugated blanks, each blank having two outer side panels connected to inner side panels of the blank by parallel score lines, one of said outer panels having an outwardly extending flap thereon for receipt of glue for adhering said one outer panel to the other outer panel of the blank; feeding blanks one at a time from said supply into a gripping mechanism and securely gripping the leading edge of said blank with said gripping mechanism; intermittently pulling said gripped blank along a work path including a glue applying station, a folding station and a compressing station; applying glue to said outwardly extending flap at said glue applying station; folding said outer panels inwardly about said score lines at said folding station while said blank is stopped to position said outwardly extending flap in overlapping relationship with respect to the other outer panel; compressing said flap against said other panel at said compressing station while said blank is stopped until the glue on said flap bonds said flap to said other outer panel; thereafter releasing said gripping mechanism to free the folded and glued blank for movement independent of said gripping mechanism; engaging the trailing end of said blank with the leading edge of a following gripping mechanism; and moving said following gripping mechanism to push said folded and glued blank out of said work path to a discharge zone.

39. The method of claim 38 further characterized by securing gripping the leading edge of the blank at laterally spaced locations by a pair of gripper mechanisms, and engaging the leading edge of the blank against a locating abutment associated with each gripper mechanism prior to movement of said blank along said work path.

40. The method of claim 38 including the step of conveying a liner into superposed relationship with said blank while said blank is stopped upstream of said folding station, and adhering said liner to said blank prior to said folding step.

41. A gripper mechanism for use in a container blank folding and gluing machine comprising:

a bracket having means thereof for attaching the bracket to a conveyor; a first blank clamping member fixedly secured to said bracket; a second blank clamping member pivotally mounted on said bracket, said second blank gripping member having an arcuately shaped toothed blank gripping surface thereon facing a blank gripping surface on said first blank clamping member; means biasing said second blank clamping member to urge the toothed blank gripping surface thereon toward the blank gripping surface on said first blank clamping member; whereby the leading edge of a blank may be inserted between said first and second blank clamping members so as to pivot said second blank clamping member relative to said bracket, said blank being securely clamped between said blank gripping surfaces through the action of said biasing means, the free end of said first clamping member being inclined away from said toothed gripping surface to define an enlarged opening facilitating insertion of the leading edge of the blank; stop means inwardly of said enlarged opening for engaging the leading edge of the blank; abutment means on said second blank clamping member for pivoting said second blank clamping member relative to said bracket against the bias of said biasing means and for moving said toothed blank gripping surface relative to the blank gripping surface on said first blank clamping member for releasing said blank gripping surfaces from clamping engagement with said blank; and an upright pusher surface adapted to engage the trailing edge of a blank at an end of the gripper mechanism opposite from said enlarged opening.

42. Apparatus for folding and gluing container blanks comprising:

frame means having a blank loading end and a blank discharge end; conveyor means mounted for movement relative to said frame means from the blank loading end thereof to the blank discharge end thereof; at least two laterally spaced gripper means on said conveyor means, each said gripper means having gripper jaw means adapted to receive and securely hold the leading edge of a container blank when the gripper means is located at the blank loading end of said frame means, said gripper jaw means being configured to open by insertion of the leading edge of said blank into said gripper means whereby said blank is secured thereby; dispensing means on said frame means for applying glue to said blank for adhering a flap of said blank; folding means on said frame means downstream of said dispensing means for folding said blank about parallel score lines and to position said flap in juxtaposed relationship with respect to a side panel of the blank; pressure-applying means on said frame means downstream of said folding means for applying pressure to said flap whereby said flap is adhered to said side panel; release means on said frame means downstream of said pressure-applying means for opening said gripper jaw means and releasing said blank therefrom; and means for discharging the folded and glued blank from the discharge end of the frame means.

43. Apparatus as set forth in claim 42 including drive means for moving said conveyor means intermittently relative to said frame means, said folding means being operable when said conveyor means is stopped, said conveyor means being arranged to move the blank through a straight-line horizontal work path between said loading and discharge ends of said frame means.

44. Apparatus as set forth in claim 42 including a second conveyor means mounted for movement relative to said first mentioned conveyor means in a direction perpendicular to a straight-line path of movement of said first mentioned conveyor means, said second conveyor means being located upstream of said folding means; and releasable gripper means on said second conveyor means for transporting a liner into superposed relationship with respect to said blank.

45. Apparatus as set forth in claim 42 wherein said folding means includes a first folding mechanism adjacent to said first conveyor means and a second folding mechanism adjacent to said conveyor means opposite said first folding mechanism, and drive means operatively associated with said first and second folding mechanisms for simultaneously applying opposite and generally equal folding forces to said blank.

46. Apparatus as set forth in claim 45 wherein each folding mechanism includes at least one arm member mounted for pivotal movement relative to said frame means, and fluid motor means for pivoting said arm members to fold said blank about said parallel score lines.

47. Apparatus as set forth in claim 46 including means for moving said folding mechanisms inwardly and outwardly relative to said frame means so as to accommodate blanks of different size.

48. Apparatus for folding and gluing container blanks comprising: frame means having a blank loading end and a blank discharge end;

first conveyor means mounted for movement relative to said frame means along a first straight-line work path from the loading end of the frame means to the blank discharge end thereof; gripper means on said first conveyor means, said gripper means having a gripper jaw mechanism adapted to receive and securely hold the leading edge of a container blank when the gripper means is located at the blank loading end of said frame means; dispensing means on said frame means downstream of said blank loading end for applying glue to said blank; second conveyor means mounted for movement relative to said frame means along a second straight-line work path perpendicular to said first straight-line work path; releasable gripper means on said second conveyor for transporting a liner into superposed relationship with respect to said blank; folding means on said frame means downstream of said dispensing means for folding said blank and superposed liner about parallel score lines to position a flap of said blank in juxtaposed relationship with respect to a side panel of the blank; compression means on said frame means downstream of said folding means for applying pressure to said flap, whereby said flap is adhered to said side panel; release means on said frame means downstream of said compression means for opening the gripper jaw mechanism and releasing said blank therefrom; and means for discharging the folded and glued blank from the discharge end of the frame means.

49. Apparatus as set forth in claim 48 wherein said dispensing means is arranged to apply glue to said blank for adhering said liner thereto.

50. The method of claim 7 including the step of conveying a liner into superimposed relationship with respect to said blank upstream of said folding station, and adhering said liner to said blank prior to said folding step.

51. The method of claim 7 wherein said conveying step is performed by intermittently moving said blank along a horizontal straight-line work path, said folding and pressure applying steps being performed while said blank is stopped.

52. The method of claim 51 wherein said folding step is performed by simultaneously applying folding forces to said outer panels from opposite sides of said panel at said folding station.

53. The method of claim 52 in which said folding step is further characterized by simultaneously pivoting folding arms into engagement with said outer panels, and controlling the rate of movement of one of said folding arms whereby said outwardly extending flap is positioned in juxtaposed relationship with respect to the other outer panel.

54. The method of claim 53 including the further step of moving hold-down means into engagement with said juxtaposed flap for bonding said flap with the other outer panel.

55. The method of claim 54 further characterized by maintaining said hold-down means in engagement with said flap as movement of said blank from said folding station toward said pressure applying station is commenced.

* * * * *